US006052854A

United States Patent [19]

Besel et al.

[11] Patent Number: 6,052,854

[45] Date of Patent: Apr. 25, 2000

[54] FLOOR CLEANING APPARATUS HAVING A FOAM DISTRIBUTING DEVICE THEREIN

[75] Inventors: Arlen Dale Besel, Elkton, Md.; James Kirk Hendrix, Woodstock, Ga.

[73] Assignee: E. I. du Pont de Nemours and Company, Wilmington, Del.

[21] Appl. No.: 09/212,639

[22] Filed: Dec. 16, 1998

[51] Int. Cl.[7] ..... A47L 05/00

[52] U.S. Cl. ..... 15/50.1; 15/385; 15/29

[58] Field of Search ..... 15/49.1, 50.1, 15/87, 385, 320, 29; 239/263.1

[56] References Cited

U.S. PATENT DOCUMENTS

| | | | |
|---|---|---|---|
| 4,191,589 | 3/1980 | Halls et al. . | |
| 4,191,590 | 3/1980 | Sundheim . | |
| 4,339,840 | 7/1982 | Monson | 15/320 |
| 5,438,728 | 8/1995 | Kubes et al. | 15/49.1 |
| 5,517,715 | 5/1996 | Monson . | |
| 5,522,114 | 6/1996 | Allison . | |
| 5,528,787 | 6/1996 | Cutler . | |
| 5,587,021 | 12/1996 | Hoersch et al. . | |
| 5,711,051 | 1/1998 | Roden | 15/385 |
| 5,865,374 | 2/1999 | Barta et al. | 15/263.1 |

FOREIGN PATENT DOCUMENTS

| | | |
|---|---|---|
| 256323 | 2/1927 | Italy . |

*Primary Examiner*—Robert J. Warden, Sr.
*Assistant Examiner*—Andrew Aldag

[57] ABSTRACT

A fluid distribution device for distributing cleaning fluid to the floor surface comprises a hollow tube extender attached to a hollow fixed shaft. A hub assembly having a plurality of hollow open-ended spokes is rotatably mounted to the tube extender. If used with a brush floor cleaning apparatus a portion of each spoke extends into and terminates within a radial passage in the brush.

3 Claims, 4 Drawing Sheets

FLOOR CLEANING APPARATUS HAVING A FOAM DISTRIBUTING DEVICE THEREIN

BACKGROUND OF THE INVENTION

1. Field of the Invention

The present invention relates to a floor cleaning apparatus and, in particular, to a floor cleaning apparatus having a device to distribute a cleaning solution, particularly a foam solution, to a floor during operation of the cleaning apparatus.

2. Description of the Prior Art

A well known prior art floor cleaning apparatus is that manufactured by Diversey Lever Industrial, Switzerland, and sold as the "Taski Rotary Brush Foam Cleaner". This floor cleaning apparatus has a body having hollow fixed shaft therein. The interior of the shaft defines a fluid conduit. A brush is rotatably mounted with respect to the body. The brush has a bristle array which is circumferentially continuous. The bristle array has a central opening from which a plurality of radial passages extend. Each radial passage extends from the central opening to a point radially interior of the circumferential bristles. A motor rotatably drives the brush around the fixed shaft as a center of rotation. A fluid source supplies a cleaning fluid to the fluid conduit defined on the hollow interior of the fixed shaft.

When the floor surface being cleaned is a carpet, a foam cleaning fluid is commonly used. The foam is dispensed from the conduit at the center of rotation of the brush. The floor cleaning apparatus must be moved laterally by the operator to distribute the foam throughout the brush so it can be worked into the carpet. Without substantial lateral movement the foam must fill up the central opening in the brush before it moves out into the radial passages where agitation by the brush occurs.

Depending upon an operator to vigorously move the floor cleaning apparatus laterally over the floor in order to achieve distribution of the foam cleaner is inefficient. More foam than is necessary for a good cleaning is usually dispensed. Multiple passes over the same area of carpet are required for good cleaning, which inefficiently uses labor and places unnecessary wear and tear on the carpet. In addition, this mode of foam distribution often results in non-uniform cleaning of the carpet. The non-uniformity is sometimes evidenced by streaks and lanes in the carpet.

In view of the foregoing there is believed to be a need for an improved floor cleaning apparatus that places the cleaning fluid directly in the working path of the brush regardless of the path traveled by the device. There is also believed to be a need for a foam distribution device that makes more efficient use of cleaning fluid and requires fewer passes over the floor surface to accomplish uniform cleaning.

SUMMARY OF THE INVENTION

The present invention is directed toward a floor cleaning apparatus for cleaning a floor surface that is believed to overcome the perceived difficulties of the art. The floor cleaning apparatus includes a body having a hollow fixed shaft defining a fluid conduit. A brush is rotatably mounted with respect to the body. The brush has a bristle array which is continuous about its circumference. The brush has a central opening and a plurality of radial passages extending from the central opening to a point radially inward of the circumferential bristles. A motor is provided for rotatably driving the brush around the fixed shaft as a center of rotation. The apparatus is connectable to fluid source which supplies a cleaning fluid to the fluid conduit in the fixed shaft.

In accordance with the present invention the floor cleaning apparatus includes a fluid distribution device for distributing cleaning fluid to the floor surface being cleaned. The fluid distribution device itself comprises a hollow tube extender having a first end and a second end. The first end of the tube extender is attached, as by threads, to the fixed shaft and in fluid communication with the conduit. A hub assembly is rotatably mounted to the second end of the tube extender. The mass of the hub assembly is balanced about its center of rotation. The hub assembly has a plurality of hollow open-ended spokes, with each spoke being in fluid communication with the tube extender. A portion of each spoke extends into each of the radial passages in the brush so that the open end of each spoke terminates in a radial passage. At least one spoke is contactable by the brush for simultaneous rotation therewith. In operation, fluid emanating from the fluid source through the fluid conduit is conveyed through the tube extender and into the hub and, from the hub, by each of the spokes into the radial passages in the brush during the simultaneous rotation of the brush and hub.

In another aspect the present invention is directed to a fluid distributing device comprising a hollow tube extender with a threaded portion on one end and an enlarged portion with a support shoulder on the opposed end. A hub assembly having a plurality of hollow open-ended spokes is rotatably mounted to the enlarged end of the tube extender. The hub assembly with its spokes is balanced about the center of rotation of the hub assembly. The hub assembly has a bearing sleeve closely fitting around the tube extender and engaging the support shoulder on the enlarged portion of the tube extender. The hub assembly has a chamber in fluid communication with the hollow tube extender and with the hollow open-ended spokes extending radially outward therefrom. The open end of each spoke terminates at a point remote from the chamber. Fluid from a fluid source is able to be conveyed through the tube extender, into the rotating hub assembly and to the open end of each of the spokes where it is freely discharged during rotation of the hub assembly relative to the tube extender.

The hub assembly is axially slidable along the tube extender from a first position where the hub can freely rotate relative to the tube extender to a second position where the hub engages the tube extender so that torque applied to the hub is transmitted to the tube extender for rotating the threaded end of the tube extender. The tube extender has a first geometric feature and the hub assembly has a second geometric feature designed to mate with the first feature on the tube extender as a result of said axial displacement to thereby transmit said torque.

BRIEF DESCRIPTION OF THE DRAWINGS

The invention will be more fully understood from the following detailed description thereof, taken in connection with the accompanying drawings, which form a part of this application, and in which.

DETAILED DESCRIPTION OF THE INVENTION

Figure 1:
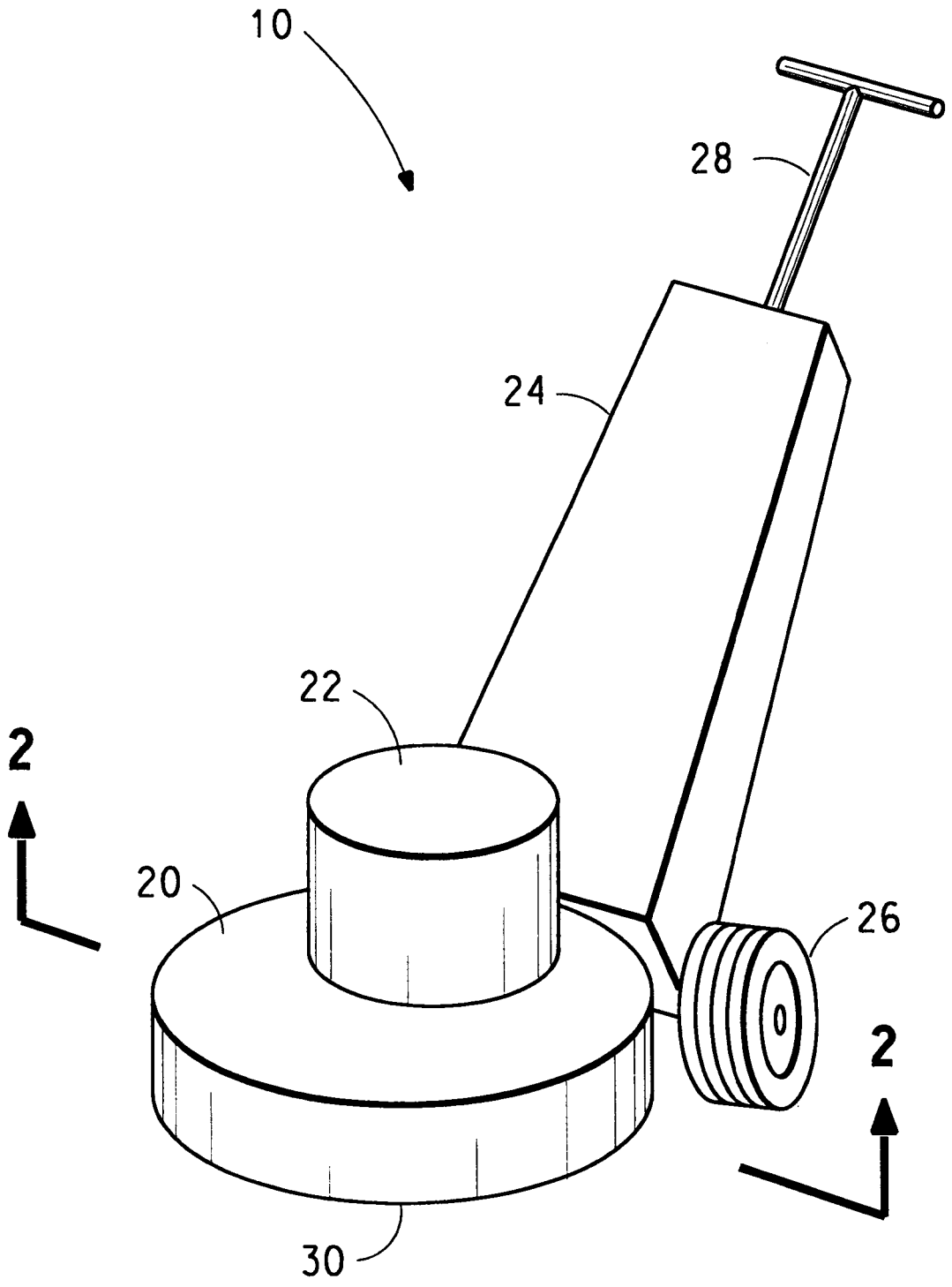
FIG. 1 is a perspective view of the floor cleaning apparatus having a fluid distribution device in accordance with the present invention.

Throughout the following detailed description similar reference numerals refer to similar elements in all figures of the drawings.

FIG. 1 is a perspective view of the exterior configuration of a floor cleaning apparatus generally indicated by the reference character 10 having included therein a fluid distribution device 12 (FIGS. 2 through 5) in accordance with the invention. The floor cleaning apparatus 10 is generally similar in exterior appearance to the "Taski Rotary Brush Foam Cleaner" manufactured by Diversey Lever Industrial, Switzerland.

The apparatus 10 has a body 20 on which a motor support enclosure 22 is mounted. A fluid reservoir, or source, 24 is attached to the body 20. A pair of wheels 26 (only one of which is visible in FIG. 1) is mounted to the body 20 or reservoir 24, as is convenient. The apparatus 10 is transportable on the wheels 26 when tilted rearwardly using the handle 28. The body 20 includes a shroud 30 surrounding a rotary brush 32 (FIGS. 2, 3).

Figure 2:
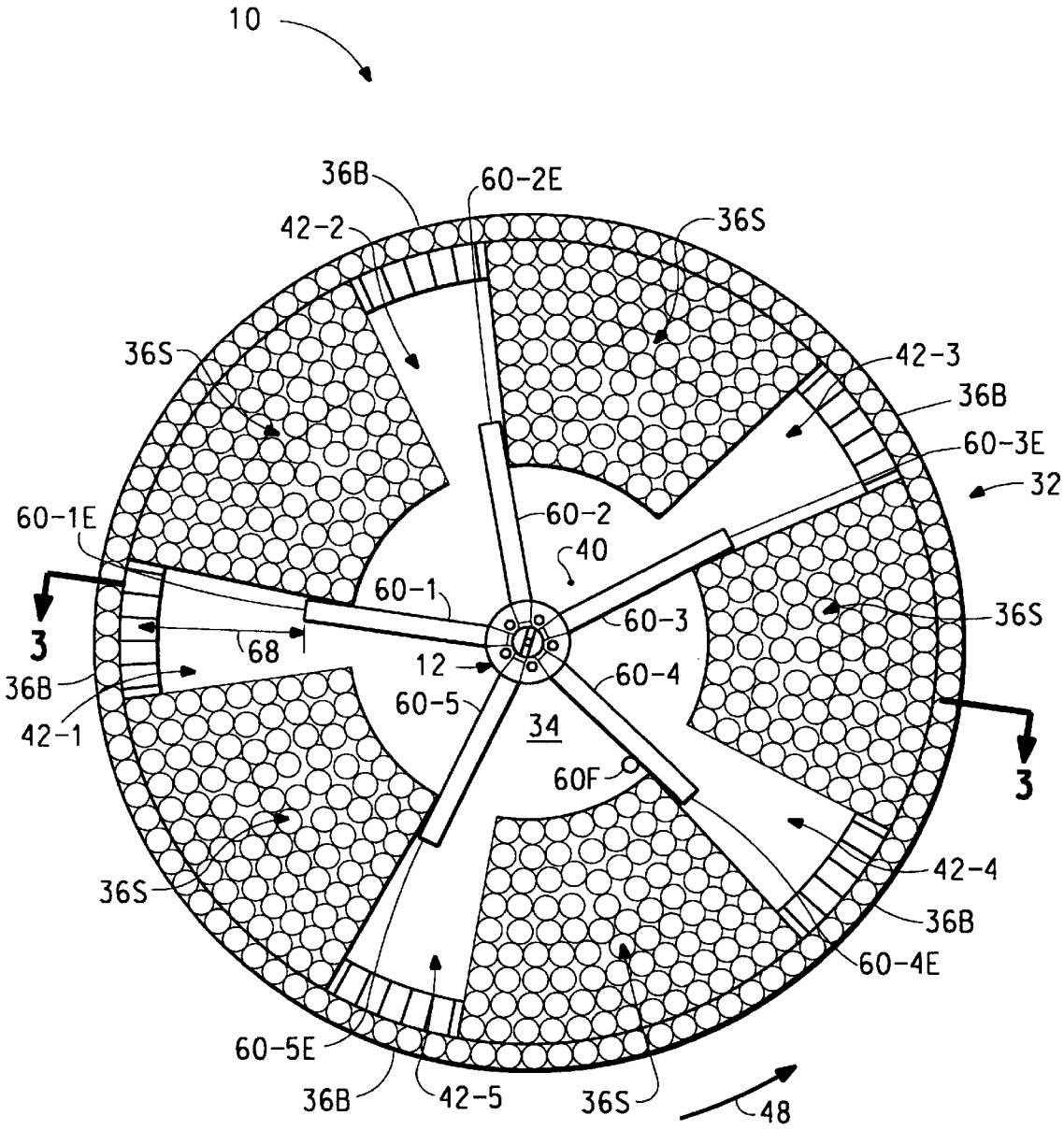
FIG. 2 is a bottom view taken along view lines 2—2 looking up at the brush and the fluid distribution device of FIG. 1.
Figure 3:
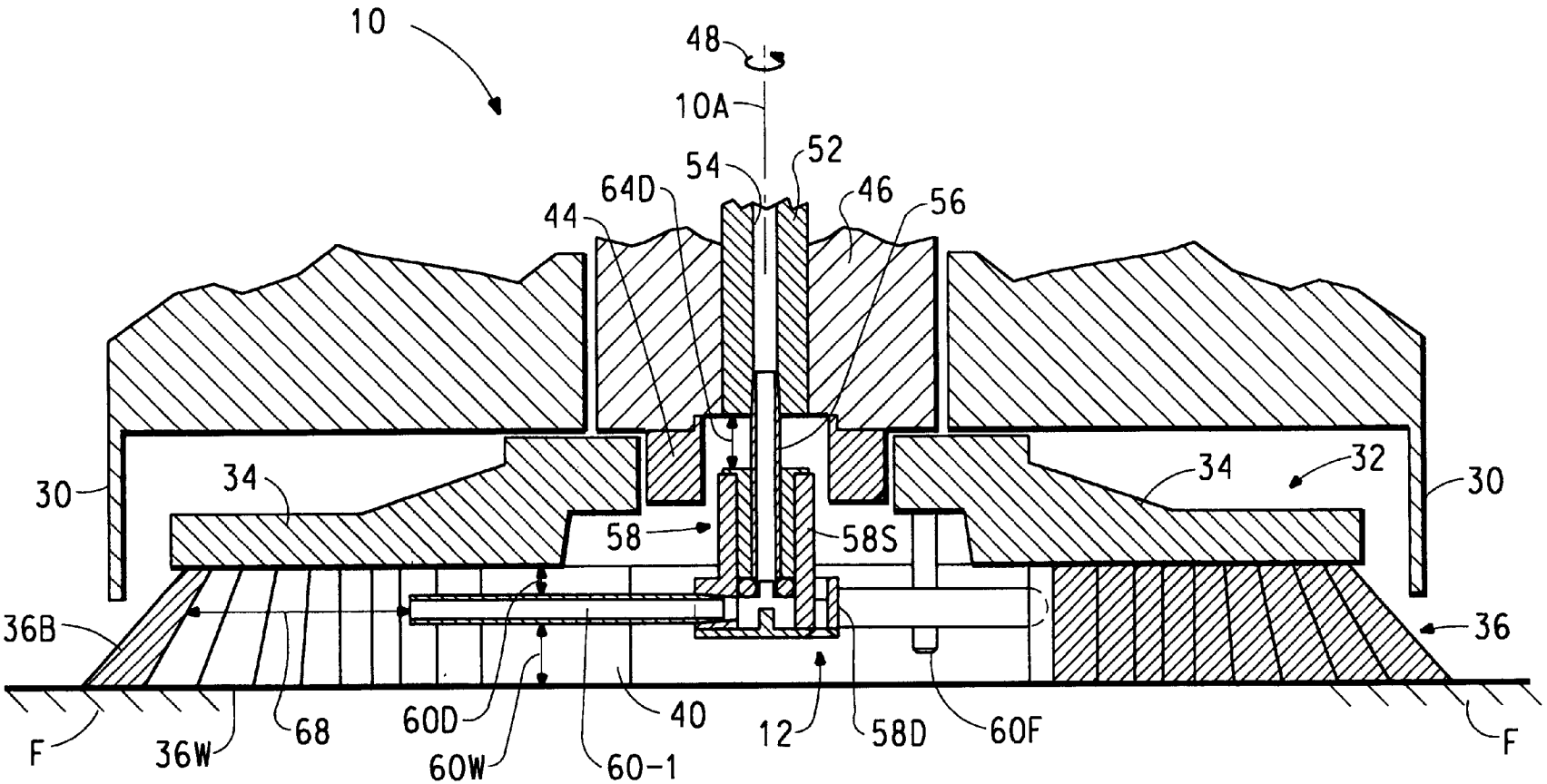
FIG. 3 is a partial section through the brush and fluid distribution device taken along section lines 3—3 in FIG. 2, with portions on the undersurface of the baseplate being omitted for clarity of illustration.

FIGS. 2 and 3 are respective bottom and side sectional views of the apparatus 10 of FIG. 1 showing the rotary brush 32 and the relationship of the fluid distribution device 12 with respect thereto. The rotary brush 32 includes a baseplate 34 from which depends an array of bristles 36. The working surface 36W of the bristle array 36 is in contact with the floor F to be cleaned. As seen in FIG. 2 the bristle array 36 includes a plurality of circumferentially spaced bristle sections 36S. The radially outer portions of adjacent bristle sections 36S are connected by bridge portions 36B, such that the bristle array 36 is circumferentially continuous about its periphery. As is best seen in FIG. 3 the circumferentially continuous peripheral portion of the bristle array 36 is angled outwardly relative to the axis 10A of the apparatus toward the shroud 30. The radially inner ends of the bristle sections 36B cooperate to define a generally circular central opening 40 on the undersurface of the brush 32 (as viewed in FIG. 2). In addition, circumferentially adjacent bristle sections 36S cooperate to define radially extending passages 42-1, 42-2, 42-3, 42-4, and 42-5 that extend from the central opening 40 to a point radially inwardly of the bristles in the bridge portions 36B. Thus, the central opening 40 and the passages 42-1 through 42-5 are without bristles.

The section view in FIG. 3 shows the baseplate 34 of the rotary brush 32 attached by a drive ring 44 to a motive element 46. The motive element 46 is itself attached and forms part of the drive motor (not shown) that serves as the motive source to provide rotary motion to the brush 32 and its bristle array 36. The motive element rotates the brush 32 in a direction 48 (FIGS. 2 and 3) around a hollow, fixed shaft 52. The hollow interior of the shaft 52 serves as a fluid conduit 54, for a purpose as will be described. The shaft 52 is attached to the body 20. The conduit 54 within the shaft 52 is connected in fluid communication with a source of cleaning fluid, such as the fluid reservoir 24 mounted to the apparatus 10 as illustrated in FIG. 1. It should be understood, however, that the source of cleaning fluid need not be carried on the apparatus 10, but may be disposed in a separate vessel and connected to the shaft 52 by a suitable connection, such as a hose or the like.

Figure 4:
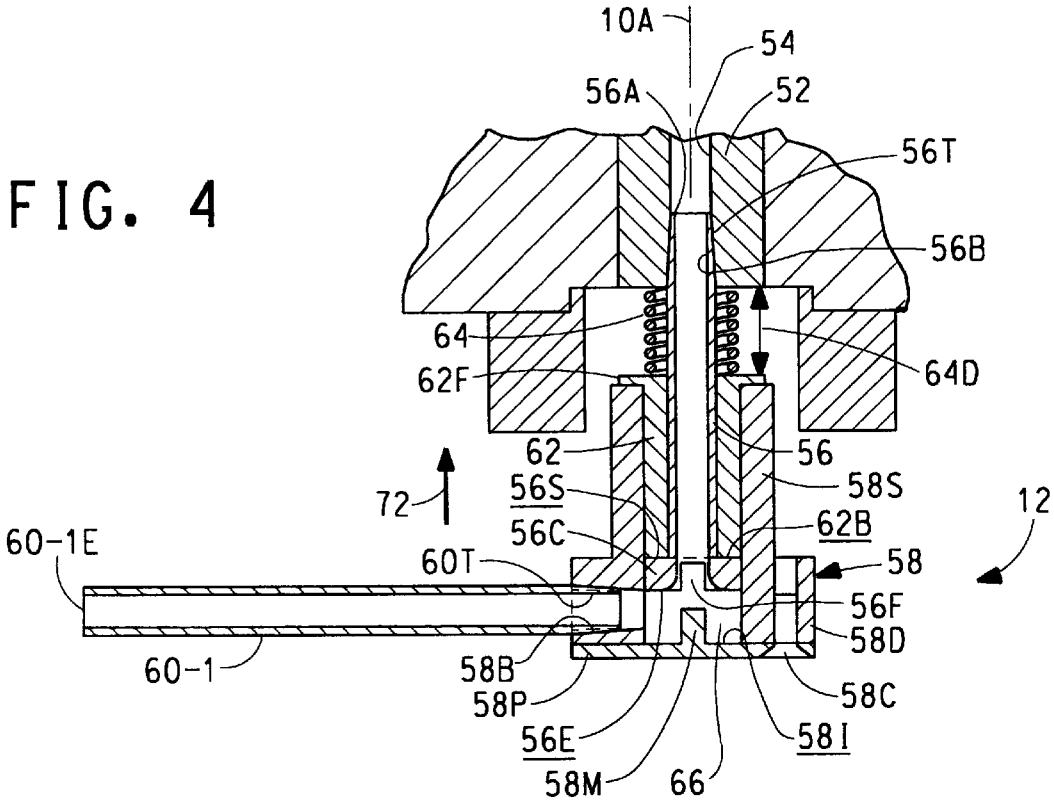
FIG. 4 is an enlarged section view of the fluid distribution device shown in FIG. 3 having a slot and tang mating geometric feature.

The fluid distribution device 12 in accordance with the present invention is believed best seen in the enlarged detail view shown in FIG. 4. The fluid distribution device 12 is positioned in the central opening 40 of the brush 32.

In the illustrated embodiment the fluid distribution device 12 includes a tube extender 56 and a hub assembly 58 mounted rotatably with respect thereto. The tube extender 56 is an elongated member having a central axial bore 56B extending therethrough. The tube extender 56 has a first (upper) tapered end 56A and an enlarged collar 56C at its second (lower) end. The end surface 56E of the collar 56C is interrupted by a cutout portion 56F provided for a purpose to be described. The annular planar support surface 56S formed on the collar 56C serves a purpose also to be described. The tapered upper end 56A of the tube extender 56 has threads 56T that engage with threads provided in the lower end of the fixed shaft 52, thereby to engage the distribution device 12 to the apparatus 10. When so threadably engaged the bore 56B in the tube extender 56 is connected in fluid communication with the conduit 54 in the shaft 52.

The distribution device 12 also includes a generally tubular, hollow hub member 58. The hub member 58 has an enlarged distributor portion 58D from which a generally cylindrical sleeve 58S (FIG. 4) coaxially extends. Radially extending threaded through bores 58B are provided in the distributor portion 58D. The hub 58 also includes a plurality of hollow, open-ended spokes 60-1, 60-2, 60-3, 60-4 and 60-5 each of which is connected, as by threads 60T, into a respective radially extending through bore 58B in the distributor portion 58D of the hub 58.

A bearing 62 having an upper flange 62F is securely attached, as by a press fit, glue or screws, to the inner surface of the cylindrical sleeve portion 58S of the hub 58. When assembled, as seen in FIG. 4, the bearing 62 is both rotatable and axially slidable with respect to the exterior of the tube extender 56. A bearing material found to work well is a Delrin® polyester resin material made by the E. I. du Pont de Nemours and Company, Wilmington, Del. Bearings of this material can be press fit into the hub and is not adversely affected by common floor cleaning fluids. A spring 64 serves to bias the planar annular bearing surface 62B of the bearing 62 into facial contact with the annular planar surface 56S on the collar 56C of the tube extender 56. The spring 64 is captured in the clearance space 64D defined between the flange 62F on the bearing and the lower end of the shaft 52. It should be noted that the bearing sleeve 62 may be integral with the hub 58 or, if desired and appropriate modifications made, attached to or formed integrally with the tube extender 56.

The distributor portion 58D of the hub assembly 58 has a plate 58P connected thereto, as by screws 58C. The plate 58P closes the hub 58 at its lower end. The interior surface 58I of the plate 58P carries a male feature 58M in the form of a tang or blade. The male feature 58M is contoured to match the geometric configuration of the cutout (female) portion 56F provided in the collar 56C. The interior surface 58I of the plate 58P, together with the end surface 56E of the collar 56C and the interior surface of the distributor portion 58D cooperate to define a chamber 66. The chamber 66 lies in fluid communication with the bore 56B through the hollow tube extender 56, and is thereby in fluid communication, through the conduit 54 on the interior of the shaft 52, with the fluid source 24. In addition the chamber 66 lies in fluid communication with the through bores 58B in the distributor 58D and, thus, with the hollow spokes 60-1 through 60-5.

As is best illustrated in FIG. 2 each of the spokes 60-1 through 60-5 extends radially outwardly from the hub 58 into a respective radial passage 42-1 through 42-5 of the brush 32. Owing to the position of the hub 58 with respect to the lower end of the shaft 52 each of the spokes 60-1 through 60-5 is spaced a predetermined distance 60W above the working surface 36W of the bristle array 36. In addition, each of the spokes 60-1 through 60-5 is spaced below the surface of the baseplate 34 by a clearance distance 60D. Each of the spokes 60-1 through 60-5 extends into a respective one of the radial passages 42-1 through 42-5 so that the distal, open end E of each of the spokes 60-1 through 60-5 terminates at a point that is radially within its associated passage 42-1 through 42-5. The open end E of each spoke should be spaced a sufficient radially distance 68 inwardly from the inner surface of the bridge portions 36B of the bristle array 36 so that fluid dispensed from the spokes is not projected radially through the peripheral portion of bristles 38. The mass of the hub assembly 58 is balanced about its axis of rotation 10A.

In operation, when the brush 32 rotates it engages the spokes 60-1 through 60-5 due to their extension into the radial passages 42-1 through 42-5 of the bristle array. The spokes 60-1 through 60-5 contact the radial side of each of the bristle sections 36S, causing the spokes 60-1 through 60-5 to move with the rotating brush 32, thereby rotating the entire hub assembly 58 about the axis 10A of the apparatus 10. Of course, it should be appreciated that any alternate arrangement may be used to cause the hub 58 to rotate with the brush 32, such as a pin 60F or other suitable feature extending between the baseplate 34 and one of the spokes 60.

The bearing sleeve 62 permits free rotation of the hub assembly 58 about the tube extender 56. The surface 62B of the bearing 62 abuts against the support surface 56S of the tube extender to support the bearing 62 against the force of gravity and to maintain the hub assembly 58 spaced the distance 60W from the working surface 36W of the bristles. The cleaning fluid (such as a viscous foam) under pressure from the fluid source 24 is dispensed from the free ends 60E of the spokes 60-1 through 60-5 into the radial passages 42-1 through 42-5 in the bristle array. This action rapidly and uniformly distributes the cleaning fluid to the working surface 36W of the bristle array 36 so that the surface of the floor F is rapidly and uniformly cleaned.

In the prior art, without the distribution device 12 of the present invention, cleaning fluid is dispensed from the end of the hollow fixed shaft 52 and into the central opening 40 in the bristle array 36. It takes considerable time and traverse motion of the brush 36 across the floor before the fluid is uniformly applied to the floor surface being cleaned. In practice, several passes of the bristle array over an area of floor are necessary to obtain uniform application of cleaning fluid. This process is time consuming, tiring to the operator, and frequently results in non-uniform cleaning.

A comparative test was conducted where an area of floor was cleaned with a floor cleaning apparatus both with and without the fluid distribution device of the invention. When the fluid distribution device 34 was added to the floor cleaning apparatus, thirty percent (30%) less foam was used and twenty-five percent (25%) less time was required to achieve the same level of cleaning.

After floor cleaning is complete the rotary brush 32 and fluid distribution device 12 must be removed for maintenance in anticipation of the next cleaning job. The geometric male feature 58M (the tang) on the hub assembly 58 and the mating geometric female feature 56F (the cutout) on the tube extender 56 facilitate removal of the fluid distribution device 12. To remove the distribution device 12 the hub assembly 58 is axially displaced in the direction of the arrow 72, against the bias of the spring 64, to bring the male feature 58M into mating engagement with the female feature 56F in the tube extender 56. The hub assembly 58 is rotated counterclockwise to apply torque to the tube extender 56 and unscrew the threaded connection between the tube extender 56 and the fixed shaft 52. During rotation of the hub assembly 58 the brush 32 will also rotate freely on the cleaning device. The distances 60D, 64D are sized to provide sufficient clearance between the top of the hub assembly 58 and the bottom of the fixed shaft 52 and between top of the spokes 60 and the bottom of the baseplate 34 to accommodate the axial displacement of the hub 58. After removal of the fluid distribution device 12 the rotary brush 32 can also be removed from the drive ring 44 in a conventional manner for maintenance. The plate 58P is easily removable from the distributor 58D (via the screws 58C) to facilitate assembly and disassembly of the tube extender 56 from the hub assembly 58.

An alternative mode of removal of the tube extender 56 from the shaft 52 is afforded by removal of the plate 56F and insertion of a bladed implement (such as a screwdriver) into engagement with the cutout 56F on the extender 56.

Figure 5:
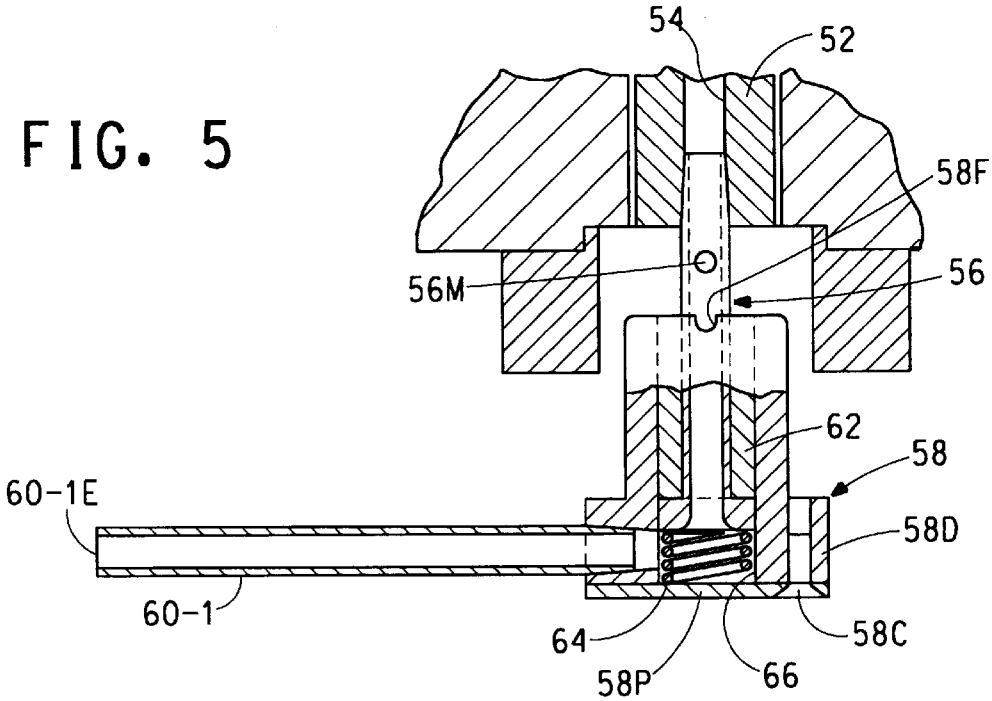
FIG. 5 is an alternate embodiment of the fluid distribution device shown in FIG. 4 having a pin and slot mating geometric feature.

In general, the relative position of the male feature 58M (e.g., the tang) on the hub 58 and the female feature 56F (e.g., the cutout) on the extender may be reversed. FIG. 5 shows such an alternate embodiment wherein the male feature is defined by a pin 56M carried on the tube extender 56. The female geometric feature 58F takes the form of a cutout disposed on the upper edge of the hub 58. Again, when the hub assembly 58 is axially moved upward in the direction 72 the pin 56M engages the slot 58F so that torque applied to the hub assembly 58 is transmitted to the tube extender 56 to engage or disengage the threaded end of the tube extender from the fixed shaft 52. Although only one pin 56M and one mating slot 58F are shown in this view, another pin and mating slot may be present displaced one hundred eighty degrees from those shown to be engaged simultaneously with the pin and slot shown to provide additional torque transmission capability.

It is also noted in the embodiment of FIG. 5 that the bias spring 64 is disposed within the chamber 66 between the lower end of the tube extender 56 and the interior surface of the plate 58P. In either embodiment the spring 64 serves to prevent engagement of the male and female features during operation of the apparatus 10. The spring 64 should not be so strong as to make engagement of the geometric features too difficult for the operator during the maintenance operation, and the spring should not apply undue force to bias the features apart during the floor cleaning operation when free rotary movement of the hub assembly relative to the tube extender must be maintained. The spring 64 is not required for the operation of the fluid distribution device, and for that reason is not illustrated in FIG. 3.

Those skilled in the art, having the benefit of the teachings of the present invention as hereinabove set forth, may effect numerous modifications thereto. Such modifications are to be construed as lying within the contemplation of the present invention, as defined by the appended claims.

What is claimed is:

1. In an apparatus for cleaning a floor surface, the apparatus having a body, the body having a hollow shaft extending therethrough, a brush rotatably mounted with respect to the shaft, the brush having a bristle array, the circumferential margin of the bristle array being continuous, the bristle array having a central opening and a plurality of radial passages each extending from the central opening to a point radially inwardly of the circumferential margin of the bristle array, a motive source mounted in the body for rotatably driving the brush about the shaft, the improvement comprising a fluid distribution device itself comprising:

a hollow tube extender having a first end and a second end, the first end attached to the shaft and in fluid communication with the hollow interior thereof;

a hub assembly rotatably mounted to the second end of the tube extender, the hub assembly having a plurality of hollow open-ended spokes, a portion of each of the spokes extending into said radial passages in the brush so the open end of the spoke terminates therein, each spoke being in fluid communication with the tube extender, the hub assembly mass being balanced about the center of rotation of the hub assembly, whereby a fluid introduced from a fluid source into the hollow shaft is able to be conveyed through the tube extender and into the hub and by each of the spokes into the radial passages in the brush during rotation of the brush and hub.

2. The apparatus of claim 1, wherein the hub assembly is axially displaceable along the tube extender from a first position where the hub can freely rotate relative to the tube extender during a cleaning operation to a second position where the hub engages the tube extender so that torque applied to the hub is transmitted to the tube extender for rotating the first end of the tube extender;

the tube extender having a first geometric feature and the hub assembly having a second geometric feature designed to mate with the first geometric feature on the tube extender as a result of the axial displacement of the hub assembly to thereby transmit said torque.

3. The apparatus of claim 2, wherein the hollow tube extender has an enlarged portion with a support shoulder on the second end and the hub assembly is rotatably mounted to the enlarged portion of the tube extender and the hub assembly has a bearing sleeve closely fitting around the tube extender and engaging said support shoulder.

* * * * *